US009987512B1

(12) United States Patent
Romfo

(10) Patent No.: US 9,987,512 B1
(45) Date of Patent: Jun. 5, 2018

(54) TRICEP ROPE WITH PERPENDICULAR HANDLES

(71) Applicant: Leslie Allen Romfo, Scottsdale, AZ (US)

(72) Inventor: Leslie Allen Romfo, Scottsdale, AZ (US)

(73) Assignee: Leslie Romfo, Scottsdale, AZ (US)

( * ) Notice: Subject to any disclaimer, the term of this patent is extended or adjusted under 35 U.S.C. 154(b) by 0 days. days.

(21) Appl. No.: 15/363,784

(22) Filed: Nov. 29, 2016

Related U.S. Application Data

(60) Provisional application No. 62/267,126, filed on Dec. 14, 2015.

(51) Int. Cl.
*A63B 21/00* (2006.01)
*A63B 23/12* (2006.01)

(52) U.S. Cl.
CPC ..... *A63B 21/4035* (2015.10); *A63B 23/12* (2013.01)

(58) Field of Classification Search
CPC ..... A63B 21/4035; A63B 21/4043; A63B 21/0552; A63B 21/0557; A63B 23/12; A63B 21/1476; A63B 21/1469; A63B 21/1484; A63B 21/152
USPC ..... 482/139; D21/694
See application file for complete search history.

(56) References Cited

U.S. PATENT DOCUMENTS 5,924,966 A * 7/1999 Havlovic ..... A63B 21/023 482/129
7,090,622 B2 * 8/2006 Hetrick ..... A63B 21/00043 482/139
7,470,224 B1 * 12/2008 Everett ..... A63B 21/04 482/121
8,043,197 B2 * 10/2011 Hetrick ..... A63B 21/0023 482/904
8,088,047 B2 * 1/2012 Marji ..... A63B 5/20 482/82
D728,711 S * 5/2015 Taylor ..... D21/694
2001/0011054 A1 * 8/2001 O'Shea ..... A63B 5/20 482/82
2006/0035761 A1 * 2/2006 Saint George ..... A63B 5/20 482/82
2006/0111221 A1 * 5/2006 Williams ..... A63B 21/4043 482/139
2011/0245050 A1 * 10/2011 Emick ..... A63B 23/03508 482/139
2016/0346589 A1 * 12/2016 Emick ..... A63B 21/152

* cited by examiner

*Primary Examiner* — Andrew S Lo

(57) ABSTRACT

A tricep rope with a perpendicular handle includes a rope with a bracket positioned in a center for mounting the rope onto a cable machine and a perpendicular handle attached to each end of the rope by a proximal part. A human user holds a distal part of the handle that positions a human body in a proper alignment during exercising. The handle also allows the user to effectively disinfect the handle after exercising.

3 Claims, 1 Drawing Sheet

TRICEP ROPE WITH PERPENDICULAR HANDLES

RELATED APPLICATION

This application claims priority to provisional patent application U.S. Ser. No. 62/267,126 filed on Dec. 14, 2015, the entire contents of which is herein incorporated by reference.

BACKGROUND

The embodiments herein relate generally to a tricep rope attached to a perpendicular handle on each end of the rope and to a bracket in a center of the rope for mounting. The perpendicular handle allows a user to position their body in a proper alignment while exercising. The proper alignment avoids injuries as well as alleviates pain due to previous injuries. The handles can also be disinfected easily due to a smooth surface. Prior to this invention, the tricep ropes had knobs on each end that did not position the user body in the proper alignment causing injuring as well as aggravating pain due to previous injuries. Further, knobs on the tricep ropes were difficult to disinfect.

SUMMARY

A tricep rope with a perpendicular handle includes a rope with a bracket positioned in a center for mounting the rope onto a cable machine and a perpendicular handle attached to each end of the rope by a proximal part. A human user holds a distal part of the handle that positions a human body in a proper alignment during exercising. The handle also allows the user to effectively disinfect the handle after exercising.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
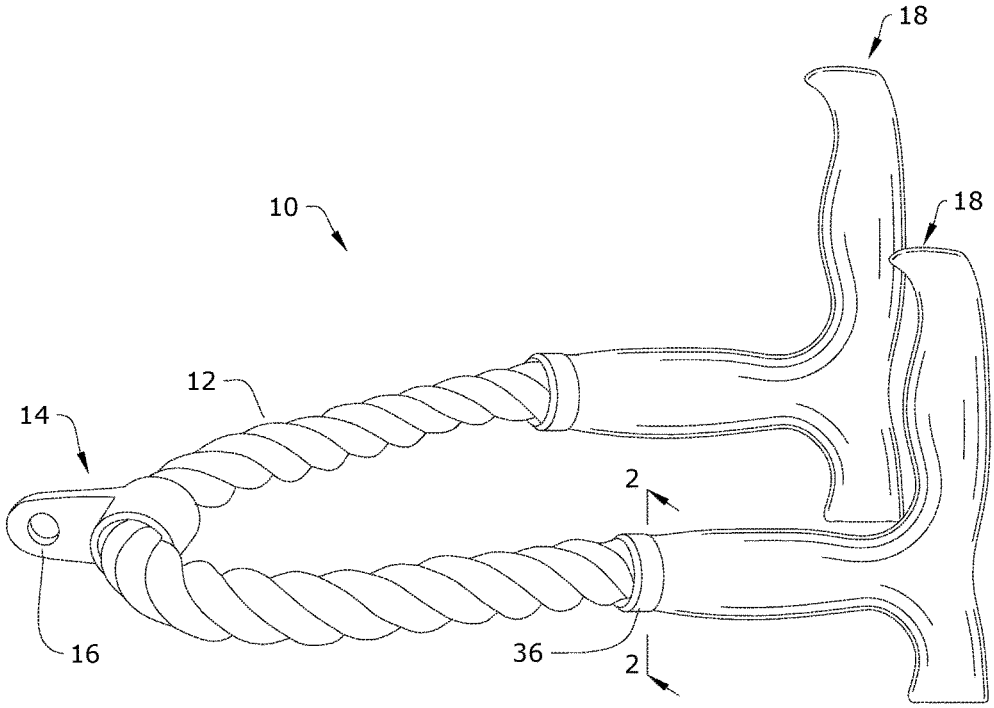
FIG. 1 shows a perspective view of one embodiment of the present invention.
Figure 2:
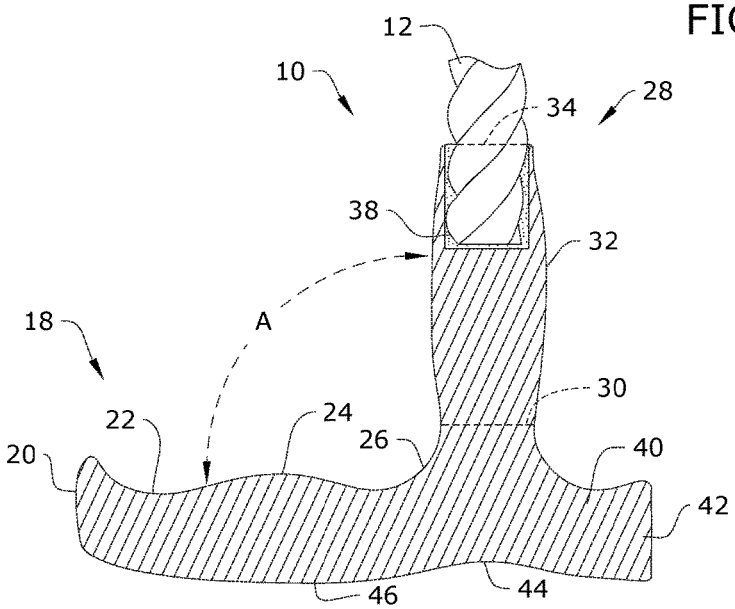
FIG. 2 shows a section detail view of one embodiment of the present invention taken along line 2-2 in FIG. 1.

By way of example, and referring to FIGS. 1 and 2, one embodiment of the present system of a tricep rope with handles 10 comprises a rope 12 having a center flanked by two ends. A bracket 14 is slid through the rope to be positioned at the center so that the rope can be mounted to a stable surface by using a fastener through a bracket attachment hole 16. Further, a perpendicular handle 18 (90 degree handle) is attached to the ends of the rope. The perpendicular handle has a proximal part attached to the rope and a distal part perpendicular to the proximal part. The proximal part further has a long curved surface and a short surface on either side of the distal part of the handle. The long and short surfaces allow the user to firmly hold the handle while exercising.

Handle 18 further comprises first flared end 20 smoothly connected to first inner concave portion 22. First inner concave portion 22 is joined to a second inner concave portion 26 with an inner convex portion 24 in between.

Second inner concave portion 26 is smoothly joined to perpendicular portion 28. Perpendicular portion 28 further comprises a small cross section proximate portion 30, a convex central portion 32 and a small cross section distal portion 34. A distal end 36 of the perpendicular portion is bored with cavity 38. The small cross section proximate portion 30 is further adjacent to outer concave portion 40 which terminates in second flared end 42. Flared end 42 is smoothly joined to central concave portion 44. Central concave portion 44 is smoothly joined to first flared end 20 with outer convex portion 46. From the cross-sectional view as shown in FIG. 2, the handle 18 has the perpendicular portion 28 with a first cross-sectional side smoothly joined to the second inner concave portion 26 adjacent the small cross section proximate portion 30, and a second cross-sectional side of the perpendicular portion 28 is smoothly joined to the outer concave portion 40 which is also adjacent the small cross section proximate portion 30. As also shown in FIG. 2, the handles 18 each have an vertical axis that extends linearly through a respective end of the rope 12 through the perpendicular portion 28; the axis being positioned between the second inner concave portion 26 and the outer concave portion 40 and extending through the central concave portion 44 such that the axis is aligned with the end of the rope 12 and the central concave portion 44.

To make the invention, nylon rope with 1¼" diameter is used. Then the metal bracket is slid onto the rope to position at the center of the rope. The perpendicular handles are manufactured by injection molding and by using materials such as plastic and metal. The handles are then attached to the ends of the rope by the distal part of the handle.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A tricep rope having two ends with a handle on each end of the tricep rope for proper alignment of a human body during exercising, the tricep rope further comprising:

a bracket slid onto the tricep rope and positioned at a center of the tricep rope and configured for mounting the tricep rope onto a cable machine by fastening a cable through an attachment hole on the bracket;

wherein the handles each have a first portion having a cavity attached to an respective end of the tricep rope and a second portion perpendicular relative to the first portion, wherein each handle further comprises:

a first flared end smoothly connected to a first inner concave portion;

an inner convex portion joined to the first inner concave portion and a second inner concave portion;

a perpendicular portion having a first cross-sectional side smoothly joined to the second inner concave portion;

an outer concave portion smoothly joined to a second cross-sectional side of the perpendicular portion, the outer concave portion being connected to a second flared end;

a central concave portion smoothly joined to the second flared end; and an outer convex portion smoothly joined to the central concave portion and the first flared end;

wherein the handles each have an axis that extends linearly through a respective end of the rope through the first portion and second portion, the axis being positioned between the second inner concave portion and the outer concave portion and extending through the central concave portion.

2. The tricep rope of claim 1, wherein the perpendicular portion further comprises: a small cross section proximate portion, a convex central portion and a small cross section distal portion.

3. The tricep rope of claim 2, wherein a distal end of the perpendicular portion is bored with the cavity.

* * * * *